United States Patent [19]

Shuert

[11] Patent Number: 4,962,692

[45] Date of Patent: Oct. 16, 1990

[54] ROOF RIDGE VENT

[76] Inventor: Lyle H. Shuert, 1034 Stratford Pl., Bloomfield Hills, Mich. 48013

[21] Appl. No.: 386,624

[22] Filed: Jul. 31, 1989

[51] Int. Cl.[5] ..... F24F 7/02

[52] U.S. Cl. ..... 98/42.21

[58] Field of Search ..... 52/199; 98/42.21

[56] References Cited

U.S. PATENT DOCUMENTS

| | | | |
|---|---|---|---|
| 334,651 | 1/1886 | Forderer | 98/42.21 X |
| 3,236,170 | 2/1966 | Meyer et al. | 98/42.21 |
| 3,949,657 | 4/1976 | Sells | 98/42.21 |
| 4,817,506 | 4/1989 | Cashman | 98/42.21 |

OTHER PUBLICATIONS

Leigh Universal Ridge Vent Bulletin 6707–L.
Four Photographs of a Roof Ridge Vent Manufactured by Ridgeline Corporation, Detroit, Michigan.
Installation Instructions for Ridgeline Roof Vent.

*Primary Examiner*—Harold Joyce
*Attorney, Agent, or Firm*—Krass & Young

[57] ABSTRACT

A roof ridge vent of a unitary plastic construction formed in a twin sheet process by separately thermoforming upper and lower sheets and then bringing the sheets together to selectively fuse them at their interfaces. The completed roof vent includes a central longitudinal hinge portion adapted to overlie the ridge of the roof and left and right longitudinal vent portions joined integrally to the central hinge portion along their respective inboard edges and positioned at either side of the hinge portion. The vent portions are configured to define a plurality of parallel transverse passages in each vent portion extending from the outboard edge of the vent portion to a location proximate the hinge portion with each passage closed at its lower face in the outboard section of the passage and open at its lower face in the inboard section of the passage for communication with an opening provided along the ridge of the roof to provide ventilation for the space beneath the roof.

19 Claims, 3 Drawing Sheets

FIG - 7
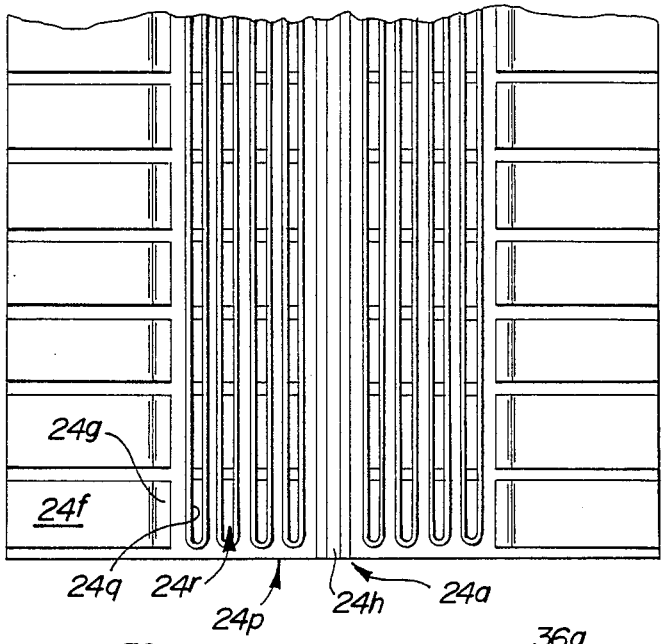
FIG - 9
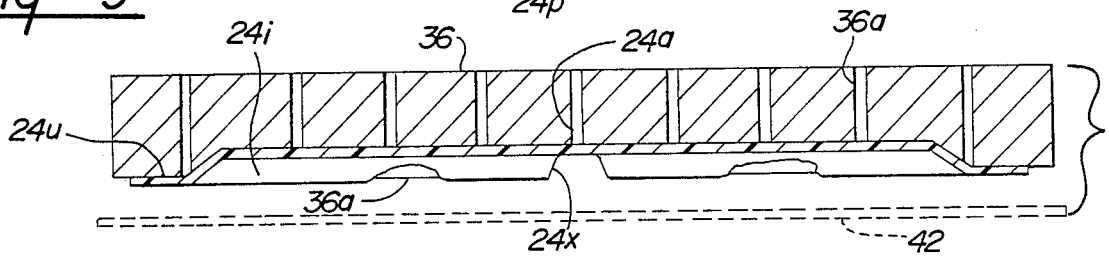
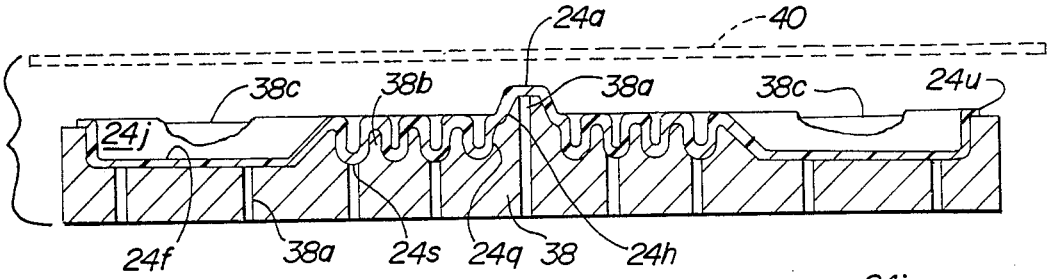
FIG - 8
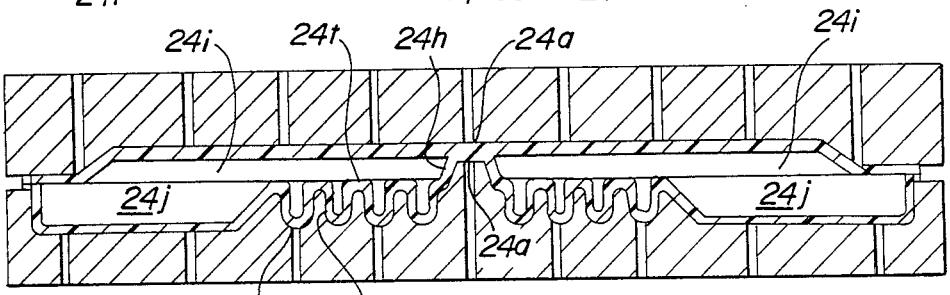
FIG - 10
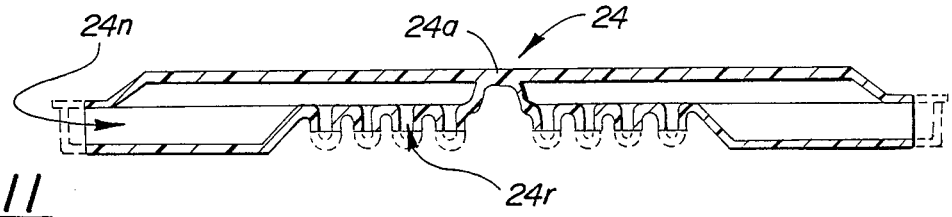
FIG - 11

ROOF RIDGE VENT

This invention relates to ventilation devices and more specifically to a vent adapted to be positioned along the ridge of a gabled roof to provide ventilation for the space enclosed by the roof.

Gable roofs require ventilation to guard against damage caused by summer heat and winter moisture build-up and to prevent premature shingle damage and deterioration. Roof ventilation devices have taken many forms including pipes or vents projecting through the roof as well as ridge vents extending along the ridge line of the roof and communicating with openings provided in the roof beneath the ridge vent so that air entering the roof, for example, through vents in the eaves of the roof may move upwardly and exit from the space beneath the roof through the ridge vent. Ridge vents may be formed of wood, metal, plastic or other materials and may take various forms. However, the plastic ridge vents are becoming increasingly popular because of their resistance to deterioration over extended periods of time and their consequent lower maintenance requirements. Whereas many forms of plastic ridge vents have been proposed and have been commercially employed, all of the available plastic ridge vents are either unduly expensive, or are subject to significant maintenance requirements, or do not provide adequate ventilation for the associated roof structure.

SUMMARY OF THE INVENTION

This invention is directed to the provision of an improved roof ridge vent.

More particularly, this invention is directed to the provision of an improved roof ridge vent of unitary plastic construction.

The invention roof ridge vent is adapted to be positioned along the central ridge of a double sloping roof to provide ventilation for the space underlying the roof. According to the invention, the vent includes a central longitudinal hinge portion adapted to overly the ridge of the roof; left and right longitudinal vent portions joined integrally to the hinge portion along their respective inboard edges and positioned at either side of the hinge portion; and means defining a plurality of parallel transverse passage in each vent portion extending from the outboard edge of the vent portion to a location proximate the hinge portion with each passage closed at its lower face in the outboard section of the passage and open at its lower face in the inboard section of the passage for communication with an opening provided along the ridge of the roof to provide ventilation for the space beneath the roof. This construction provides an inexpensive and effective roof ridge vent.

According to a further feature of the invention, each of the transverse passages is closed at its upper space by a flat, upper wall forming the upper face of the vent portion, and the lower face of each passage is stepped upwardly at the juncture of the outboard section of the passage and the inboard section of the passage to position the lower face of the inboard section in upwardly spaced relation to the underlying roof surface with the lower face of the outboard section positioned against the underlying roof surface. This specific construction provides an inexpensive manner of providing a space below the inboard sections of the transverse passages to facilitate movement of air out of the space beneath the roof outwardly through the transverse passages.

According to a further feature of the invention, means are provided on each vent portion to define a grille pattern at the lower face of the inboard sections of the transverse passages. This grille pattern at the lower face of the inboard sections of the transverse passages provides a screening effect for the vent.

According to a further feature of the invention, the vent is formed from upper and lower sheets of plastic material which are separately thermoformed and thereafter fused together to form a unitary plastic structure. This twin sheet forming technology provides an inexpensive and effective means of forming the invention roof vent.

According to a further feature of the invention, the lower sheet forms the grille pattern and the lower portions of the outboard sections of the transverse passages, and the upper sheet forms the upper portions of the outboard and inboard sections of the transverse passages. This specific arrangement as between the upper and lower sheets allows the twin sheet construction to readily provide the required transverse passages and the required grille pattern proximate the lower portions of the inboard sections of the transverse passages.

According to a further feature of the invention, the upper sheet is closed at its outboard edge and the lower sheet is open at its outboard end so that the upper portions of the outboard ends of the transverse passages are closed and the lower portions of the outboard ends of the transverse passages are open. This specific twin sheet construction provides a partial shield at the outboard ends of the transverse passages which coact with wind currents moving up the roof to create a suction which augments the exit air flow through the open lower portions of the transverse passages.

The invention also provides a method of forming a roof ridge vent. According to the invention method, the first plastic sheet is thermoformed to define an elongated upper sheet defining a central hinge portion and left and right vent portions at either side of the hinge portion with each vent portion defining a series of parallel transverse downwardly opening channels extending from the outboard edge thereof to the hinge portion; a second plastic sheet is thermoformed to define an elongated lower sheet defining a central hinge portion and left and right vent portions at either side of the hinge portion with each vent portion defining a series of parallel transverse upwardly opening channels extending from the outboard edge thereof to an intermediate location spaced outboard from the hinge portion and further defining a series of longitudinally extending ribs between the inboard ends of the transverse passages and the hinge portion; and the upper and lower sheets are fused together with the downwardly and upwardly opening channels coacting to define transverse passages extending at their upper portions from the outboard edge of the vent to the hinge portion and at their lower portions from the outboard edge of the vent to the intermediate location and with the ribs defining a series of longitudinal openings communicating at their upper ends with the upper portions of the transverse channels. This methodology allows the invention roof ridge to be readily formed utilizing twin sheet technology.

According to a further feature of the invention methodology, the lower ends of the ribs are removed following the fusion of the upper and lower sheets so that the longitudinal openings communicate at their lower ends with the space beneath the vent. This step, which may comprise for example a cutting operation, provides an air flow path extending through the lower face of the inboard sections of the transverse passages and then transversely outwardly for exit through the outboard edges of the vent portions.

According to a further feature of the invention methodology, the channels are formed with end walls closing their outboard ends and the end walls closing the outboard ends of the upwardly opening channels are removed following the fusion process so that the upper portions of the outboard ends of the transverse passages are closed and the lower portions of the outboard ends of the transverse passages are open. This step provides a ready means of utilizing twin sheet technology to partially close the outboard ends of the transverse passage to inhibit the entry of unwanted objects into the passages.

BRIEF DESCRIPTION OF THE DRAWING

FIG. 7 is a bottom fragmentary view of the invention roof ridge vent; and

FIGS. 9–11 illustrate steps in the formation of the invention roof ridge vent utilizing a twin sheet vacuum forming process.

DETAILED DESCRIPTION OF THE PREFERRED EMBODIMENT

Figure 1:
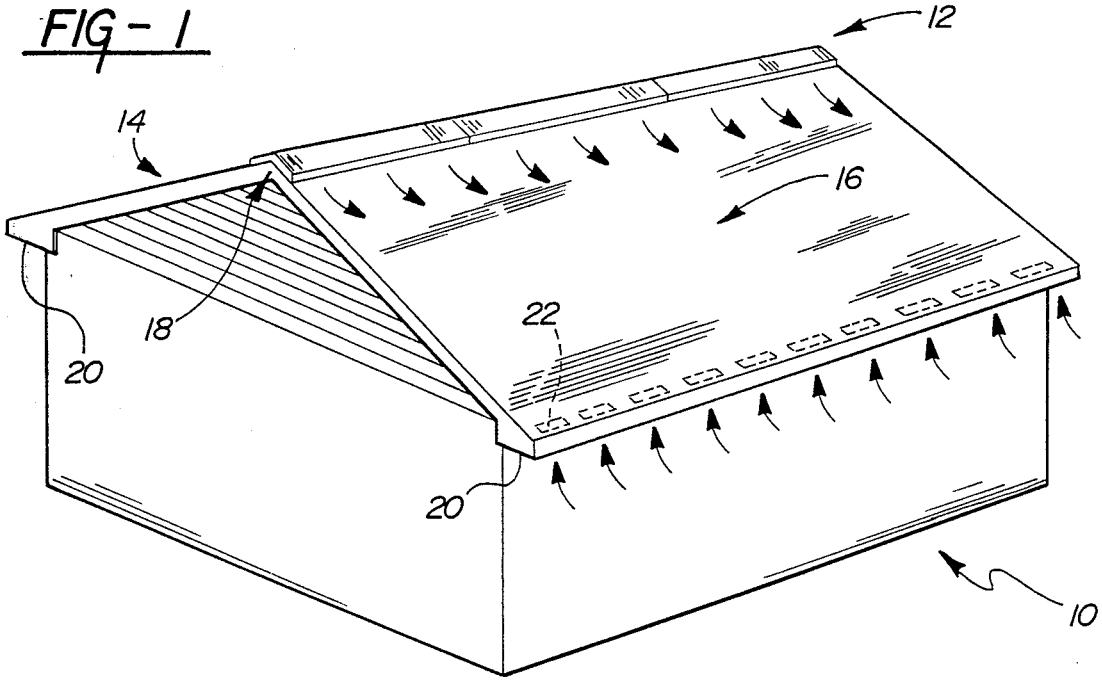
FIG. 1 is a simplified, perspective view of a gabled roof employing the invention roof ridge vent.
Figure 2:
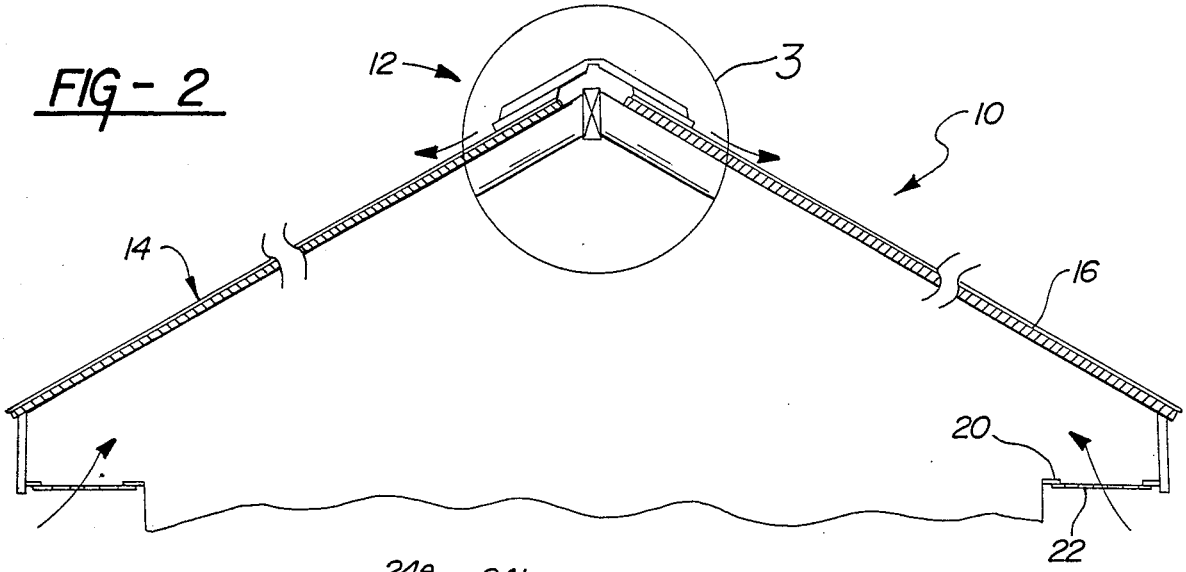
FIG. 2 is an end view of a gabled roof showing the invention roof ridge vent.
Figure 5:
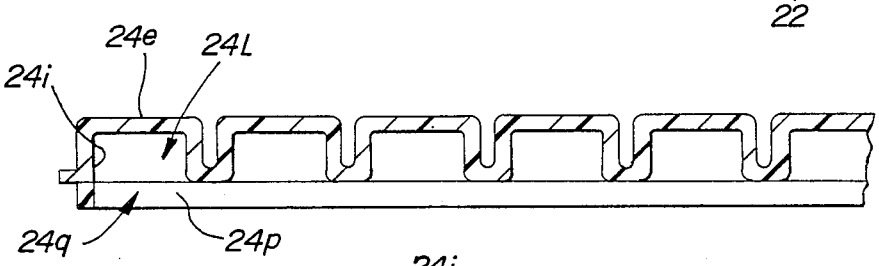
FIGS. 5 and 6 are cross-sectional views taken on lines 5—5 and 6—6 respectively of FIG. 4.
Figure 6:
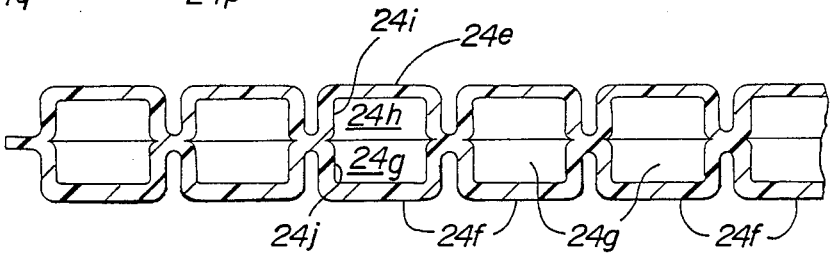
Figure 3:
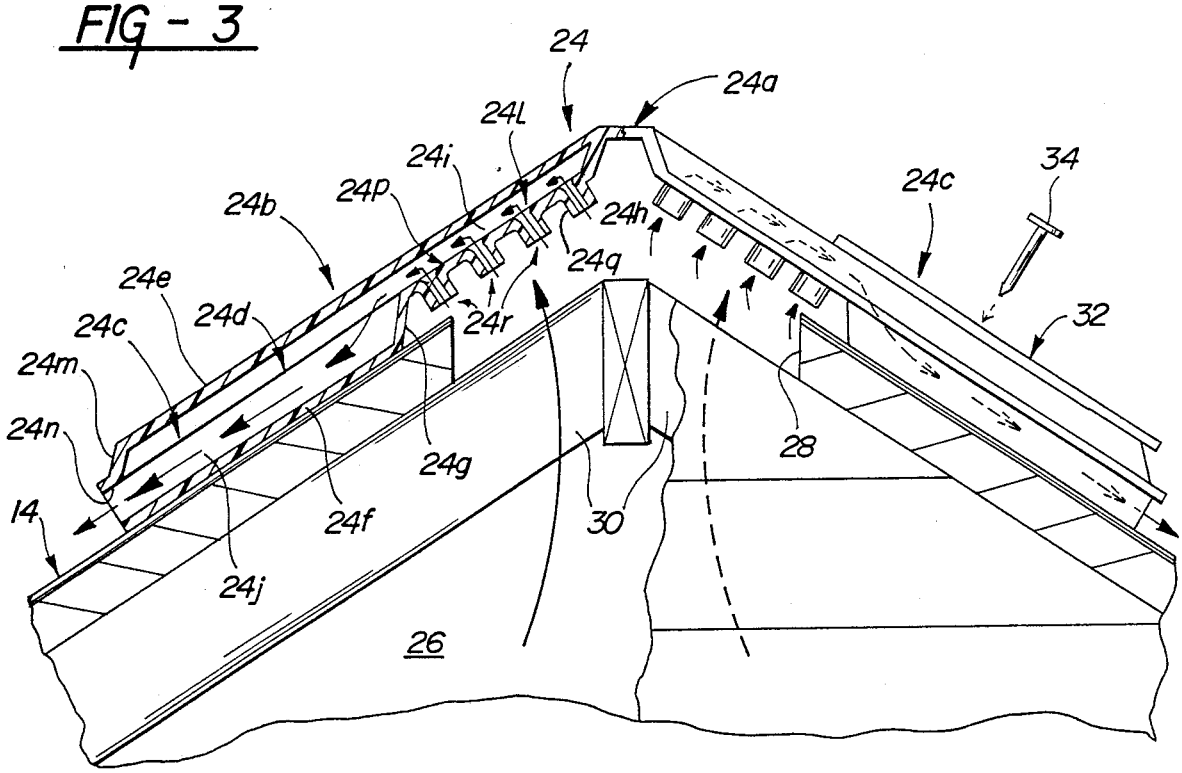
FIG. 3 is an enlarged view taken within the circle 3 of FIG. 2.
Figure 4:
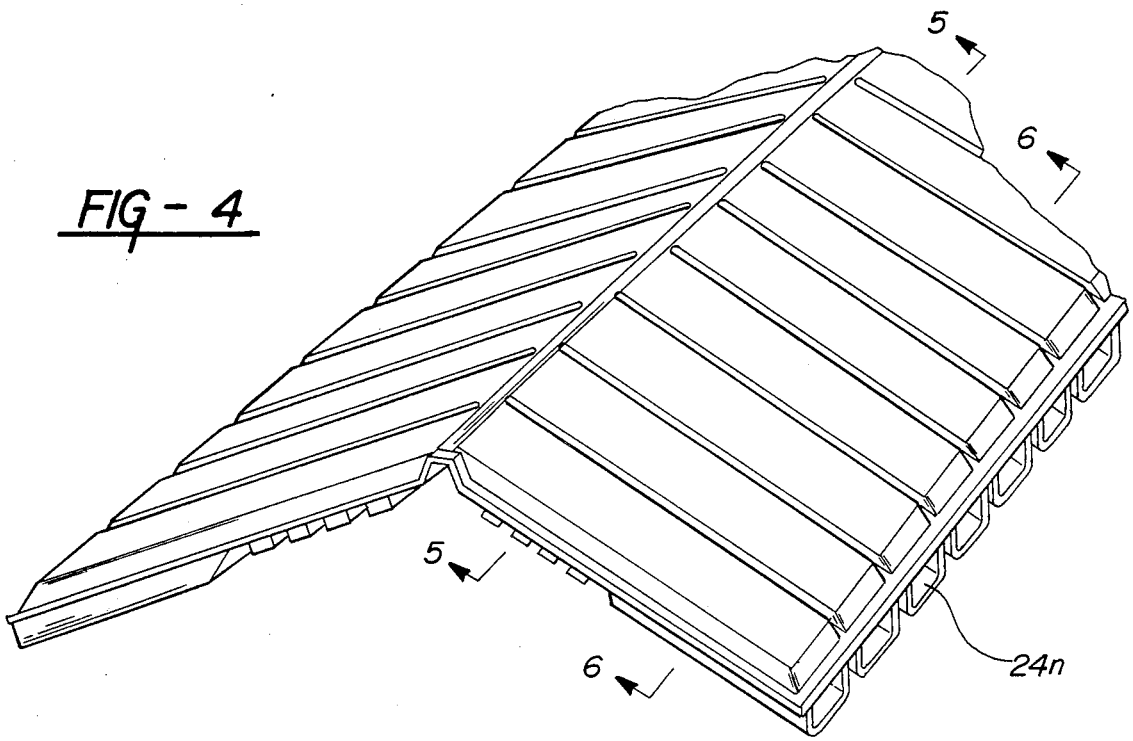
FIG. 4 is a perspective fragmentary view of the invention roof ridge vent.

FIG. 1 shows a building 10 having a gabled roof 12. Roof 12 includes oppositely sloping roof sections 14 and 16 terminating in a ridge 8, eaves 20, and eave vents 22. A roof ridge vent 24 of an inverted V configuration is positioned above ridge 18 and extends along the ridge to provide ventilation to the space enclosed beneath the roof with the air movement within the enclosed space generally comprising air entering through eave vents 22 and leaving through roof vent 24. Roof vent 24 may comprise one continuous unitary member extending the entire length of the ridge 18 or may, as shown in FIG. 1, comprise a plurality of roof vent sections laid end to end and together covering the entire length of the ridge.

Roof vent 24 is formed of a plastic material, for example, a high-density polyethylene, and includes a central longitudinal hinge portion **24*a* adapted to overlie the ridge of the roof and left and right longitudinal vent portions 24*b*,24*c* joined integrally to hinge portion 24*a* along their respective inboard edges and positioned at either side of the hinge portion in respective overlying relation to roof sections 14,16**.

Each vent portion is configured to define a plurality of parallel transverse passages **24*d* extending from the outboard edge of the vent portion to a location proximate hinge portion 24*a*. Each passage 24*d* is defined along its upper face by a flat upper wall 24*e* and is defined along its lower face by a lower wall 24*f*. Wall 24*f* includes a baffle portion 24*g* comprising an upward step in the wall 24*f* at a location between the outboard edge of the wall and hinge portion 24*a*, and further includes an inboard portion 24*h* integrally joining hinge portion 24*a*. Each transverse side of each passage 24*d* is defined by an upper partition wall 24*i* and a lower partition wall 24*j*. Partition wall 24*i* extends from the outboard edge of the vent to hinge portion 24*a* while lower partition wall 24*j* extends from the outboard edge of the vent to an intermediate location proximate baffle wall 24*g*. Partitions 24*i* and 24*j* thus coact to define an outboard transverse passage section 24*k* having a relatively large height and an inboard transverse passage section 241 having a relatively low height. For example, the height of inboard transverse passage section 241 may be one-half that of the height of outboard transverse passage section 24*k***.

The upper portion of the outboard end of each transverse passage **24*d* is closed by an angled wall 24*m* formed as a downward outboard extension of top wall 24*e*. The outboard end of the lower portion of the transverse passage is open to define an exit opening 24*n* for exit of air from the transverse passage. The portion 24*p* of lower wall 24*f* between baffle portion 24*g* and inboard portion 24*h* is selectively configured to define a plurality of parallel downwardly extending walls 24*q* defining a grille pattern in the form of a series of longitudinally extending openings 24*r* therebetween. Walls 24*q* and thereby openings 24*r* extend for substantially the full longitudinal extent of the roof vent so that openings 24*r* coact with a plurality of side-by-side transverse passages 24*d* to provide an entrance for air into the transverse passages from the space 26 underlying the roof. A. ventilating air flow path is thus established through eave vents 22, into enclosed space 26, and then upwardly through an opening 28 provided in the roof along the ridge line for passage through parallel grille openings 24*r* and subsequent passage outboard in transverse passages 24*d* for discharge through exit openings 24*n*** along the outboard edge of the roof vent.

Roof opening 28 is provided in known manner by removing the ridge cap shingles from the length of the ridge and then removing the roof sheathing along the length of the ridge to expose the upper ends of the rafters 30.

Following positioning of the roof vent along the roof ridge with vent portions **24*b* and 24*c* respectively positioned on roof sections 14,16, ridge cap shingles 32 are positioned along the upper face of the roof vent in known manner and roofing nails 34 are driven downwardly through the outboard sections of vent portions 24*b*,24*c*** to secure the vent to the roof sheathing in known manner.

The invention roof vent may be made in several manners but preferably is formed in a twin sheet process, illustrated in FIGS. 8–11, in which the vent is formed from upper and lower sheets of high density polyethylene plastic material which are separately thermoformed and thereafter fused together to form the unitary plastic roof vent structure.

Specifically, the twin sheet forming process is carried out utilizing multi-station rotary equipment which includes sheet heating oven stations and at least one forming station and wherein individual sheets of heated plastic are sequentially fed to the forming station for thermoforming with respect to the upper and lower molds with the sheets held and transported between the stations by rectangular clamp frames engaging the periphery of the sheets.

An upper mold 36 and a lower mold 38 are positioned at the forming station and are movable upwardly and downwardly in known manner by means not shown to accomplish the various forming operations. Although the molds are seen two-dimensionally in FIGS. 8–11, it will be understood that each mold is elongated in the unseen direction to provide the desired length of roof vent.

To perform the twin sheet molding operation, a lower sheet 40, previously heated at an oven station, is moved into position over the lower mold 38 with molds 36 and 38 separated; vacuum is applied through vacuum channels 38*a* to the upper mold face of lower mold 38 to suck sheet 40 downwardly into conformance with the upper face of the mold 38; mold 38 carrying preformed sheet 40 is moved downwardly within the press; a second sheet 42 is moved into position between the molds 36 and 38 in juxtaposition to the upper mold 36; vacuum is applied through vacuum ports 36*a* to suck the sheet 42 upwardly into conformance with the molding surface of upper mold 36; the molds are brought together as seen in FIG. 10 to selectively fuse the upper sheet 42 to the lower sheet 40 to form the roof vent the molds are thereafter separated and the roof vent removed; and the molded roof vent is selectively trimmed to form the final roof vent 24 as seen in FIG. 11.

With specific reference to lower mold 38, as best seen in FIG. 8, it will be seen that the mold 38 includes a central raised ridge portion 38*a* for forming the central hinge portion of the lower sheet; a plurality of transversely spaced longitudinal rib portions 38*b* extending substantially the entire length of the mold and operative to form parallel ribs 24*s* forming the walls 24*q* in the completed roof vent; and a series of longitudinally spaced transverse rib portions 38*c* operative to form partition walls 24*j* in the completed roof vent.

With specific reference to upper mold 36, the molding surface of this mold includes a series of transverse ribs 36*a* spaced longitudinally along each side of the mold and operative to form the partition walls 24*i* in the completed roof vent with the separate sets of ribs 36*a* separated at their inboard ends to allow the formation of hinge portion 24*a* in the upper sheet.

With reference to FIG. 10, it will be seen that as the molds are brought together to bring the formed upper and lower sheets together, the central hinge portions 24*a* of the upper and lower sheets knit or fuse together to form the central hinge portion 24*a* of the completed roof vent; the partition portions 24*i* of the upper sheet fuse at their lower transverse edges with the upper transverse edges of the partition portions 24*j* of the lower sheet to form the partitions dividing the transverse passages 24*d* in the completed roof vent; the portions 24*t* of the lower sheet interconnecting the ribs 24*s* fuse to the lower edge of partitions 24*i* of the upper sheet; the wall portions 24*h* of the lower sheet fuse to the angled inboard edges 24*y* of the partitions 24*i* of the upper sheet; and the peripheral flange portion 24*u* of the upper sheet fuses to the peripheral flange portion 24*v* of the lower sheet to form a fused flange extending totally around the periphery of the roof vent. It will be seen that the roof vent as formed by the closed molds, and as best seen in FIG. 10, defines a totally enclosed, encapsulated central space having no entrance or exit.

Following removal of the roof vent from the molds, the roof vent is transported to a suitable trimming station where the lower longitudinal edges of ribs 24*s* are removed in a suitable cutting operation to define walls 24*q* and openings 24*r*, and the outboard edges of the roof vent are trimmed to form the discharge or exit openings 24*n*. The roof vent is now ready for delivery for installation along the ridge of a roof in the manner previously described.

As will be obvious, the central live hinge portion 24*a* allows the vent portions 24*b*,24*c* to be pivoted to the precise angle defined by the sloping roofs 14 and 16 so that one standard construction of roof vent may be utilized for a wide range of roof angles. The length of each individual roof vent section will of course depend upon many variables including the size of the available molding equipment and the length of the ridges contemplated to be ventilated. In a typical application, however, each roof vent section 24 may have a width from outboard edge to outboard edge of approximately 12 inches and a length of approximately 60 inches, and the sheets 40 and 42 may have a starting thickness of 0.050 inches. Ribs 24*q* are transversely spaced to provide openings 24*r* having a transverse dimension of approximately ⅛ of an inch so that the ribs provide a grille pattern, best seen in FIG. 7, along the lower face of the inboard section of the transverse passages to provide a screening action and to satisfy code requirements with respect to the opening sizes provided by the roof vent.

The invention will be seen to provide a roof ridge vent which is extremely durable; which may be readily and inexpensively manufactured; and which provides superior ventilation when applied to the ridge of a gabled roof. In this regard, the angled walls 24*m* closing the upper portions of the outboard ends of the transverse passages 24*d* coact with wind currents moving up the roof toward the ridge of the roof to create a low pressure, suction area proximate the open lower portions of the transverse passages to thereby suck air out of the transverse passages and thereby facilitate the flow of ventilating air outwardly through the roof vent.

Whereas a preferred embodiment of the invention has been illustrated and described in detail, it will be apparent that various changes may be made in the disclosed embodiment without departing from the scope or spirit of the invention.

I claim:

1. A roof ridge vent adapted to be positioned along the central ridge of a double sloping roof to provide ventilation for the space underlying the roof, said vent including:

a central longitudinal hinge portion adapted to overlie the ridge of the roof;

left and right longitudinal vent portions joined to said hinge portion along their respective inboard edges and positioned at either side of said hinge portion;

means defining a plurality of parallel transverse passages in each vent portion extending from the outboard edge of the vent portion to a location at said hinge portion with each passage being defined by generally parallel side upper and lower walls each extending transversely from the outboard edge of the vent portion to said hinge portion to define a tubular passage open at its outboard end and extending to said hinge portion; and means defining vent openings in said lower wall of each passage proximate said hinge portion.

2. A roof ridge vent according to claim 1 wherein:

each of said passages includes an outboard section and an inboard section;

each of said passages is closed at its upper face by a flat upper wall forming the upper face of the vent portion; and the lower wall of each passage is stepped upwardly at the juncture of said outboard passage section and said inboard passage section to position the lower wall underlying the inboard passage section in upwardly spaced relation to the underlying roof surface with the lower wall underlying the outboard section positioned against the underlying roof surface.

3. A roof ridge vent according to claim 2 wherein:
each vent portion includes means on each lower wall defining a grille pattern at the lower face of the inboard sections of said transverse passages.

4. A roof ridge vent according to claim 3 wherein:
said grille pattern comprises a series of parallel openings extending longitudinally along the lower wall of the inboard sections of said transverse passages.

5. A roof ridge vent according to claim 1 wherein:
said vent comprises a unitary plastic structure.

6. A roof ridge vent according to claim 3 wherein:
said vent is formed from upper and lower sheets of plastic material which are separately formed and thereafter fused together to form a unitary plastic structure.

7. A roof ridge vent according to claim 6 wherein:
said lower sheet forms said grille pattern in the lower wall of the inboard section of said transverse passages and the lower portions of the side walls of the outboard passage sections; and
said upper sheet forms the side walls of the inboard passage sections and the upper wall of the side walls of the outboard passage sections.

8. A roof ridge vent according to claim 7 wherein:
the grille pattern formed by said lower sheet comprises a series of longitudinally extending walls defining longitudinally extending openings therebetween.

9. A roof ridge vent according to claim 7 wherein:
said upper sheet includes an end wall closing the upper portion of each passage and said lower sheet is open at its outboard edge so that the upper portion of the outboard ends of said transverse passages are closed and the lower portions of the outboard ends of said transverse passages are open.

10. A roof ridge vent comprising:
a central longitudinal hinge;
left and right vent portions on either side of said hinge portion; and
means defining a series of transverse passages in each of said vent portions extending from the outboard edge of the respective vent portion to said hinge portion with each passage having a relatively large height in the outboard section thereof and a relatively low height in the inboard section thereof;
the upper face of each transverse passage being defined by a flat upper wall of the respective vent portion and the lower face of each transverse passage being defined by a lower wall including a first outboard lower wall section underlying said relatively large height outboard passage section, an inboard lower wall section parallel to said outboard lower wall section and underlying said relatively low height inboard passage section, and an upwardly stepped baffle wall section interconnecting the inboard edge of said outboard lower wall section and the outboard edge of said inboard lower wall section; and means defining an opening in the inboard lower wall section of each transverse passage to provide communication with the space below said vent.

11. A roof ridge vent according to claim 10 wherein:
the upper portion of the inboard end of each transverse passage is closed and the lower portion of the outboard end of each transverse passage is open.

12. A roof ridge vent according to claim 10 wherein:
said opening defining means defines a grille pattern in the lower wall inboard sections of said transverse passages to provide screening action for said vent.

13. A roof ridge vent according to claim 12 wherein:
said grille pattern includes a series of narrow longitudinally extending openings in the inboard lower wall section of each transverse passage.

14. A roof ridge vent according to claim 10 wherein:
said vent is formed as a unitary plastic structure with said hinge portion comprising a live hinge and said vent portions joined integrally to said hinge portion along their respective inboard edges.

15. A method of forming a roof ridge vent comprising the steps of:
(A) thermoforming a first plastic sheet to define an elongated upper sheet defining a central hinge portion and left and right vent portions at either side of said hinge portion with each vent portion defining a series of parallel, transverse, downwardly opening channels extending from the outboard edge thereof to said hinge portion;
(B) thermoforming a second plastic sheet to define an elongated lower sheet defining a central hinge portion and left and right vent portions at either side of said hinge portion with each vent portion defining a series of parallel, transverse, upwardly opening channels extending from the outboard edge thereof to an intermediate location spaced outboard from said hinge portion and further defining a grille pattern between the inboard ends of said upwardly opening transverse channels and said hinge portion; and
(C) fusing said upper and lower sheets together with said downwardly and upwardly opening channels coacting to define transverse passages extending at their upper portions from the outboard edge of said vent to said hinge portion and at their lower portions from the outboard edge of said vent to said intermediate location and with said grille pattern positioned beneath said downwardly opening channels between said intermediate location and said hinge portion.

16. A method according to claim 15 wherein:
(D) said grille pattern is formed by forming a series of longitudinally extending ribs on said second sheet between the inboard ends of said upwardly opening channels and said hinge portion and thereafter removing the lower ends of said ribs to define a series of parallel, longitudinal openings.

17. A method according to claim 15 wherein:
(D) said channels are formed with end walls closing their outboard ends; and
(E) the end walls closing the outboard ends of said upwardly opening channels are removed so that said upper portion of the outboard ends of said transverse passages are closed and the lower portions of the outboard ends of said transverse passages are open.

18. A method according to claim 17 wherein:
(F) said grille pattern is formed by forming a series of longitudinally extending ribs on said second sheet between the inboard ends of said upwardly opening channels and said hinge portion and thereafter removing the lower ends of said ribs to define a series of parallel, longitudinal openings.

19. A method of forming a roof ridge vent comprising the steps of:

thermoforming a first plastic sheet to define an elongated upper sheet defining a central hinge portion and left and right vent portions at either side of said hinge portion with each vent portion defining a series of parallel, transverse, downwardly opening channels extending from the outboard edge thereof toward said hinge portion;

thermoforming a second plastic sheet to define an elongated lower sheet defining a central hinge portion and left and right vent portions at either side of said hinge portion with each vent portion defining a series of parallel, transverse, upwardly opening channels extending from the outboard edge thereof toward said hinge portion; and fusing said upper and lower sheets together with said downwardly and upwardly opening channels coacting to define transverse passages extending from the outboard edge of said vent toward said hinge portion.

* * * * *

UNITED STATES PATENT AND TRADEMARK OFFICE

CERTIFICATE OF CORRECTION

PATENT NO. : 4,962,692

DATED : October 16, 1990

INVENTOR(S) : Lyle H. Shuert

It is certified that error appears in the above-identified patent and that said Letters Patent is hereby corrected as shown below:

Column 3, Line 39, Please delete "8" and insert -- 18 --.

Column 4, Line 8, Please delete "241" and insert --241 --.

Column 4, Line 10, Please delete "241" and insert --241 --.

Column 4, Line 29, Please delete "A." and insert -- A --.

Column 5, Line 19, After the word vent insert -- ; --.

Column 5, Line 53, Please delete "24y" and insert -- 24x --.

Column 6, Line 54, After side & upper please insert -- , --.

Column 7, Line 9, Please delete "lower face of the"

Column 7, Line 43, After hinge please insert -- portion --.

Signed and Sealed this

Twenty-fifth Day of August, 1992

*Attest:*

DOUGLAS B. COMER

*Attesting Officer*

*Acting Commissioner of Patents and Trademarks*